US006957652B2

(12) United States Patent
Matsuoka

(10) Patent No.: US 6,957,652 B2
(45) Date of Patent: Oct. 25, 2005

(54) REGULATOR FOR DIVING

(75) Inventor: Mitsushiro Matsuoka, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 0 days.

(21) Appl. No.: 10/950,588

(22) Filed: Sep. 28, 2004

(65) Prior Publication Data

US 2005/0072427 A1 Apr. 7, 2005

(30) Foreign Application Priority Data

Oct. 6, 2003 (JP) ..... 2003-347474

(51) Int. Cl.[7] ..... A61M 16/00; A62B 23/02
(52) U.S. Cl. ..... 128/204.26; 128/205.12; 128/201.27; 128/201.28; 137/908
(58) Field of Search ..... 128/204.26, 205.24, 128/201.27, 201.28, 205.12; 137/908

(56) References Cited

U.S. PATENT DOCUMENTS 4,436,090 A * 3/1984 Darling ..... 128/204.26
4,793,340 A * 12/1988 Ottestad ..... 128/200.24
5,184,609 A * 2/1993 Hart ..... 128/205.24
5,379,761 A * 1/1995 Schuler ..... 128/205.24
5,413,096 A * 5/1995 Hart ..... 128/205.24
5,509,407 A * 4/1996 Schuler ..... 128/205.24
5,685,297 A * 11/1997 Schuler ..... 128/205.24
5,724,961 A * 3/1998 Tistrand ..... 128/205.24
5,746,198 A * 5/1998 Taba et al. ..... 128/204.26
RE36,223 E * 6/1999 Schuler ..... 128/205.24
6,332,464 B1 * 12/2001 Chen ..... 128/204.26
6,619,286 B2 * 9/2003 Patel ..... 128/204.26

FOREIGN PATENT DOCUMENTS

JP 3281339 2/2002

* cited by examiner

*Primary Examiner*—Mital Patel
(74) *Attorney, Agent, or Firm*—Clark & Brody

(57) ABSTRACT

Here is disclosed a regulator for diving free from any possibility that smooth operation of respective components might be obstructed due to the presence of impurities in the air supplied from an air cylinder. In the regulator, a tubular coupler member coupling a regulator for diving to an air hose extending from an air cylinder is provided with a filter assembly.

7 Claims, 6 Drawing Sheets

REGULATOR FOR DIVING

BACKGROUND OF THE INVENTION

The present invention relates to a regulator for diving and more particularly to such a regulator adapted to regulate a pressure of air supplied to a diver.

Japanese Patent No. 3281339 (Citation) discloses an invention relating to a regulator used for diving. This regulator comprises a coupler to low pressure air hose extending from an air cylinder tied on a diver's back to this coupler via a first stage, a pressure reducing valve adapted to be opened or closed as a diaphragm moves, a mouthpiece and a check valve for exhaust wherein an air flow passes through the low pressure hose and then the pressure reducing valve before supplied to the diver's mouth via the mouthpiece.

However, the regulator disclosed in Citation is accompanied with an anxiety that, if the air flowing from the low pressure hose into the coupler contains any extraneous substances such as dust, these extraneous substances might clog between the pressure reducing valve and its seat or accumulate along the other air passage defined between the coupler and the mouthpiece. Clogging and/or accumulation of these extraneous substances would obstruct the respective components within the regulator from smoothly operating.

SUMMARY OF THE INVENTION

An object of the present invention is to improve the conventional regulator so that the problem due to such extraneous substances can be reliably eliminated.

According to the present invention, there is provided a regulator for diving having a tubular coupler member adapted to be coupled to an air hose extending from an air source, a mouthpiece and a diaphragm, wherein an air supply channel extending from the tubular coupler member to the mouthpiece is provided with a pressure reducing valve for the air adapted to be opened and closed by movement of the diaphragm and thereby to reduce the air pressure before the air is supplied to a diver holding the mouthpiece in his or her mouth.

The regulator further comprises the tubular coupler member containing therein a filter assembly for the air.

In the regulator constructed in this manner, any impurities contained in the air can be reliably trapped in an early step of entering the regulator and it is not apprehended that these impurities might obstruct smooth operation of the respective components.

According to one preferred embodiment of the invention, the filter assembly is placed aside toward the air hose with respect to the pressure reducing valve. Such unique arrangement is effective to protect the pressure reducing valve from the problem due to the impurities.

According to another preferred embodiment of the invention, the filter assembly comprising a breathable cylindrical housing detachably press-fitted into the tubular coupler member and filter medium contained within the housing. This arrangement facilitates the filter medium to be exchanged with fresh one.

According to still another preferred embodiment of the invention, the cylindrical housing consisting of an outer cylindrical housing and an inner cylindrical housing separably inserted fast one into another, both of these outer and inner cylindrical housings being formed with air vents, and the filter medium is exchangeably contained within the inner cylindrical housing. This arrangement allows the filter medium having contained within the housing to be exchanged with fresh one.

According to further another preferred embodiment of the invention, the filter medium comprising first tubular filter medium and second tubular filter medium detachably press-fitted into the first tubular filter medium, the first tubular filter medium has meshes coarser than those of the second tubular filter medium and an air passage in the filter medium starts from the air vents formed in the outer cylindrical housing and terminates at the air vent formed in the inner cylindrical housing so that, along the air passage, the air enters the first tubular filter medium through its one end surface, after has left this medium through its inner peripheral surface, enters the second tubular filter medium through its outer peripheral surface and leaves this medium through its inner peripheral surface and reaches the air vent formed in the inner cylindrical housing. In this regulator, it is possible to prevent the second filter medium having smaller meshes from being clogged in a short period by using the first filter medium and the second filter medium which are different from each other in the mesh size.

According to additional preferred embodiment of the invention, a sheet-like third filter medium is laid at the innermost position of the air vents of the outer cylindrical housing so that the third filter medium may cover the one end surface of the first filter medium and a surface state of the third filter medium may be observed through the air vents. In this regulator, a degree of contamination on the surface of the third filter medium can be visually observed from outside the outer cylindrical housing and it can be determined whether the first through third filter media should be exchanged with fresh filter media or not.

DETAILED DESCRIPTION OF THE PREFERRED EMBODIMENTS

Details of a regulator for diving according to the present invention will be more fully understood from the description given hereunder with reference to the accompanying drawings.

Figure 1:
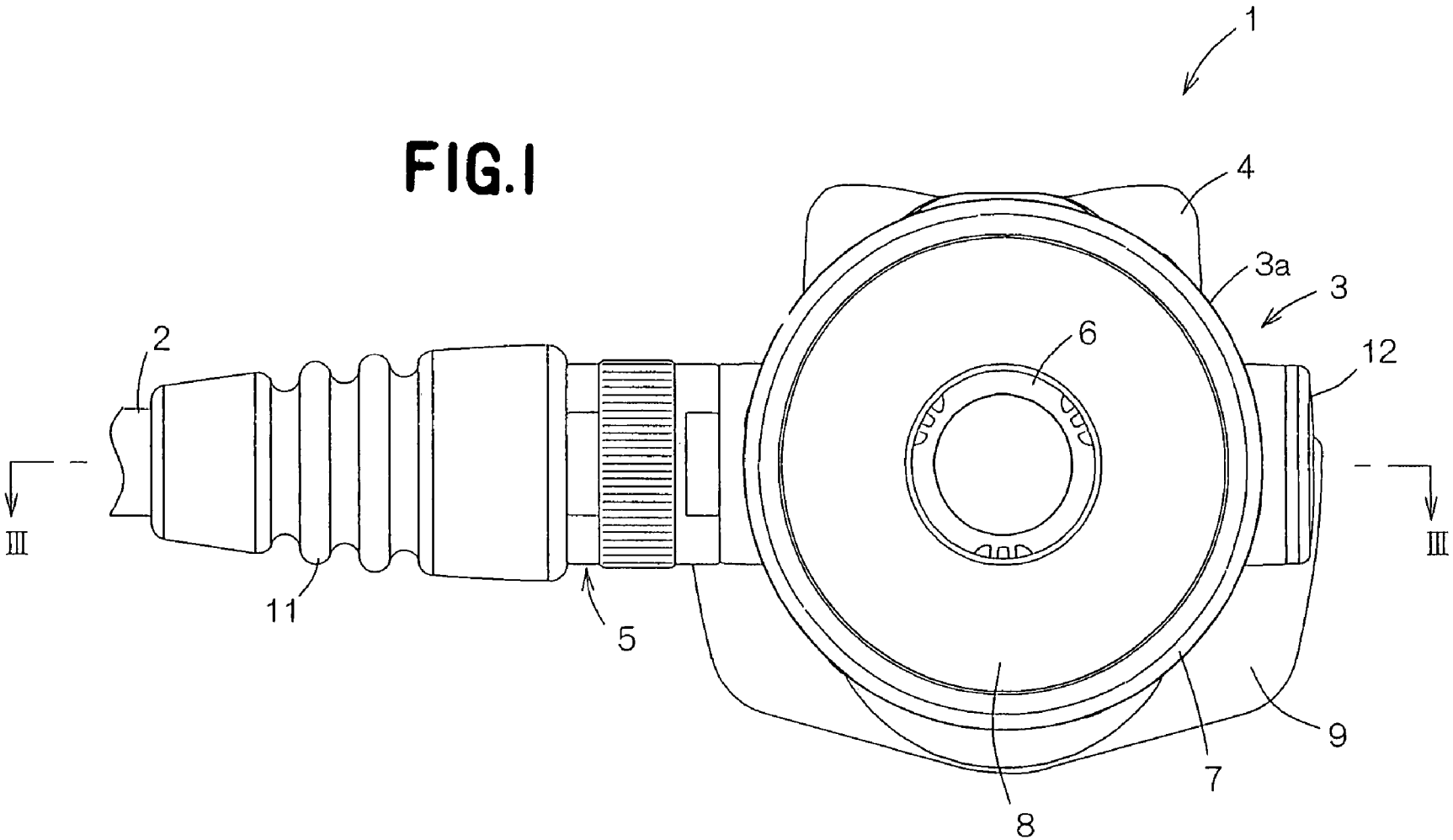
FIG. 1 is a front of the regulator.
Figure 2:
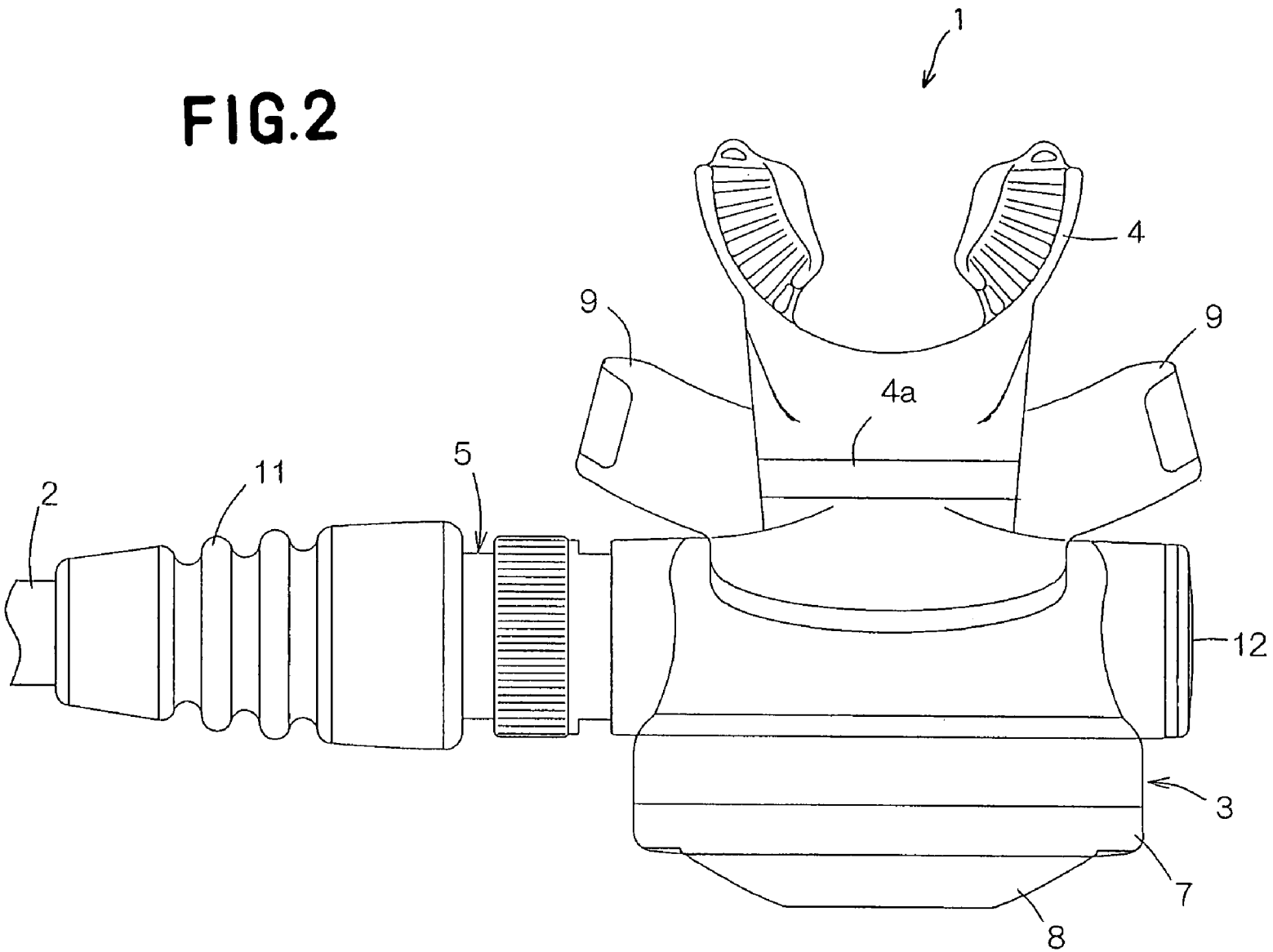
FIG. 2 is a top view of the regulator.

FIGS. 1 and 2 are front and top views, respectively, of a regulator 1. The regulator 1 is adapted to be coupled to a low pressure hose 2 extending from an air cylinder tied on the diver's back thereto via a first stage (not shown) and comprises a main body 3, a mouthpiece 4 and a coupler member 5 interposed between the main body 3 and the low pressure hose 2. The main body 3 comprises, in turn, an outer housing 3*a* made of hard plastics, a diaphragm cover 6 laid on a front side of the outer housing 3*a* and members 7, 8 used to fix the cover 6 to the outer housing 3*a*. The outer housing 3*a* is provided on its rear side with the mouthpiece 4 made of flexibly elastic material and an exhaust duct 9. The mouthpiece 4 includes a belt 4*a* put therearound. The coupler member 5 and the low pressure hose 2 lying on the left side as viewed in FIGS. 1 and 2 are partially covered with a protective cover 11 made of elastic material. A pressure regulating device is provided on the right of the outer housing 3*a*.

Figure 3:
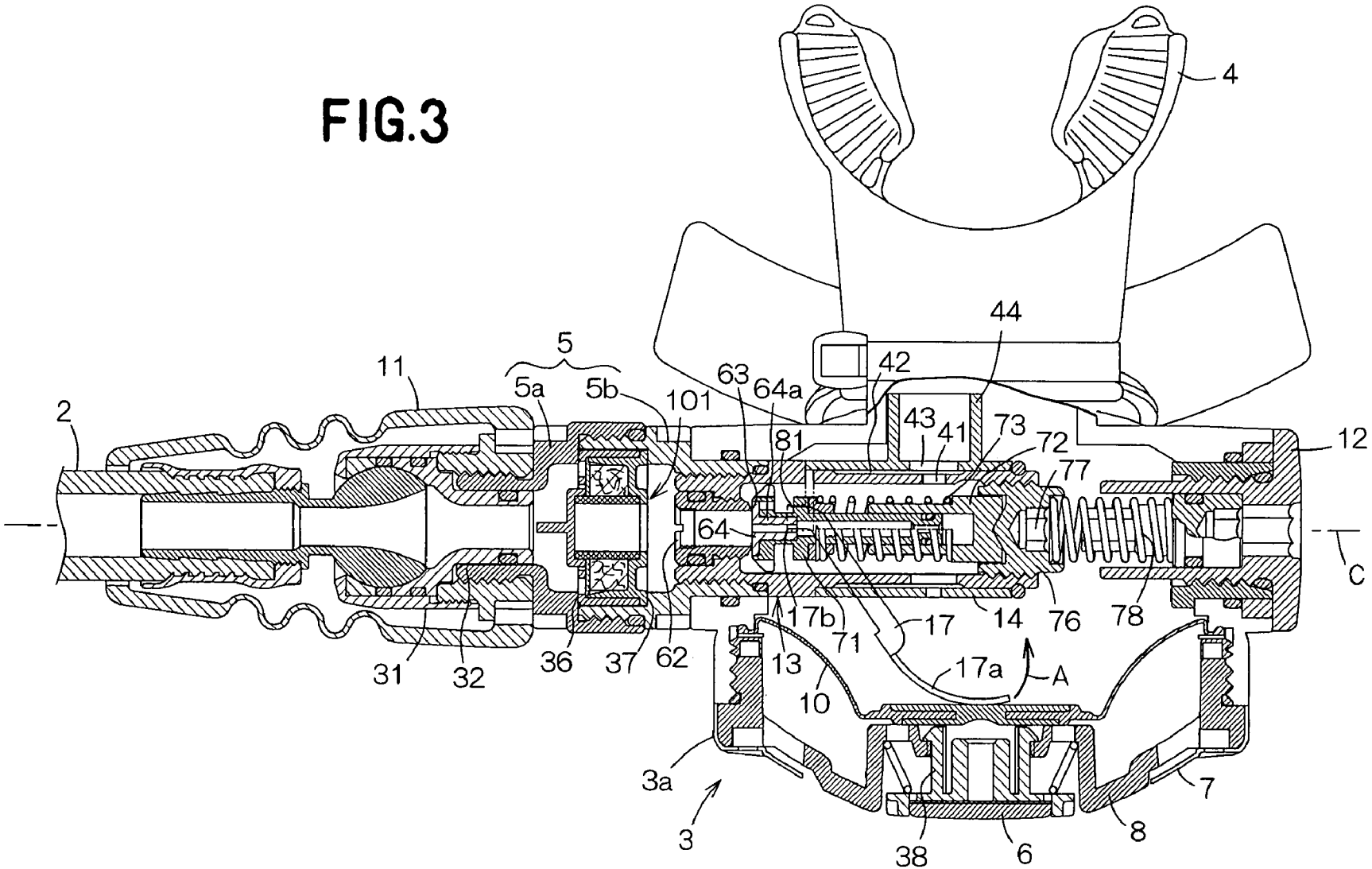
FIG. 3 is a sectional view taken along the line III—III in FIG. 1.

FIG. 3 is a partial sectional view taken along a line III—III in FIG. 1 with some of the components shown not in sectional view but in side view so that an arrangement of these components may be easily understood. On the left hand in FIG. 3, a distal end of the low pressure hose 2 opposed to the coupler member 5 is provided with a rotary joint 31. The coupler member 5 which is substantially tubular is interposed between this rotary joint 31 and the outer housing 3*a*. The coupler member 5 comprises a first coupler member 5*a* adapted to screw together with an inner peripheral surface of the rotary joint 31 and a second coupler member 5*b* adapted to screw together with an outer peripheral surface of the inner housing 13 at its left end put within the outer housing 3*a*. The first coupler member 5*a* screws together with an outer peripheral surface of the second coupler member 5*b*. The second coupler member 5*b* is provided with a filter assembly having its peripheral surface fitting fast to the inner peripheral surface of this second coupler member 5*b*. The filter assembly is held between a stepped portion 36 formed in the inner peripheral surface of the first coupler member 5*a* and a stepped portion 37 formed in the inner peripheral surface of the second coupler member 5*b* so as to be fixed within the coupler member 5 in axial dimension.

The outer housing 3*a* contains therein various components such as the tubular inner housing 13 extending in horizontal direction as viewed in FIG. 3, a guide tube 14 put fast around the inner housing 13, a cylindrical portion 38 extending inward from the diaphragm cover 6 toward the interior of the outer housing 3*a*, a diaphragm 10 coming in contact with the cylindrical portion 38 from the interior of the outer housing 3*a*, and a lever 17 coming in contact with a central zone of the diaphragm 10 from the interior of the outer housing 3*a* and extending to the interior of the inner housing 13. On the left end of the tubular inner housing 13, a pipe sleeve 62 is put fast therein and an inhalation valve 64 functioning as a pressure reducing valve is pressed against a valve seat 63 defining the right end of the pipe sleeve 62. A valve rod 64*a* of the inhalation valve 64 has a rod 64*a* extending rightward is press-fitted into a first stem 71 and a right end of this first stem 71 is press-fitted into a second stem 72. A first coil spring 73 is interposed between the first stem 71 and the second stem 72 and normally biases the first stem 71 to press the inhalation valve 64 against the valve seat 63. A right end of the second stem 72 is press-fitted into a screw member 76 which, in turn, screws together with the inner peripheral surface of the inner housing 13 so that a longitudinal position of this screw member 76 in the inner housing can be adjusted. The screw member 76 is coupled to the pressure regulating device 12 lying outside the outer housing 3*a* through the intermediary of the second stem 72. Between the screw member 76 and the pressure regulating device 12, a second coil spring 78 is interposed, which normally biases the screw member 76 to push the second stem 72 leftward as viewed in FIG. 3. The screw member 76 is moved leftward or rightward within the inner housing 13 through the intermediary of a third stem 77 as the pressure regulating device 12 is rotated clockwise or counterclockwise around a central axis C of the inner housing 13. Thus it is possible to vary a compression state of the first coil spring 73 and thereby it is possible to regulate a force with which the inhalation valve is pressed against the valve seat 63.

The lever 17 has a first end 17*a* kept in contact with the diaphragm 10 and a second end 17*b* opposed to the first end 17*a*. The second end 17*b* lies in a groove 81 formed on the left end of the first stem 71.

In this regulator 1, inhalation of the diver (not shown) holding the mouthpiece 4 in his or her mouth causes the diaphragm 10 to be deformed inward with respect to the outer housing 3*a* and thereby the first end 17*a* of the lever 17 is moved in a direction indicated by an arrow A. Along with such movement of the first end 17*a*, the second end 17*b* also moves so as to force the first stem 71 to be moved rightward. Such movement of the first stem 71 causes the inhalation valve 64 having its valve rod 64*a* press-fitted in the first stem 71 until this moment to move rightward and to be disengaged from the valve seat 63. As a result, a gap ensured between the inhalation valve 64 and the valve seat 63 so that the air from the low pressure hose 2 can flow through this gap. The diaphragm 10 returns to the position shown in FIG. 3 and the first coil spring 73 biased the first stem 71 as well as the inhalation valve 64 to return to the positions shown in FIG. 3 every time each cycle of diver's inhalation completes.

The air from the low pressure hose 2 flows through the rotary joint 31, then through the filter assembly and has its pressure reduced as passing through the gap between the inhalation valve 64 and the vale seat 63 of the pipe sleeve 62. The air pressure reduced in this manner flows into the inner housing 13. The peripheral wall of the inner housing 13 is formed at its position aside toward the right hand with an air vent 41. The air flows out from the inner housing 13 through this air vent 41 into a gap 42 defined between the outer peripheral surface of the inner housing 13 and the inner peripheral surface of the guide tube 14. The air flows through an air vent 43 and a duct 44 of the guide tube 14 into the mouthpiece 4 and to the diver's mouth.

Figure 4:
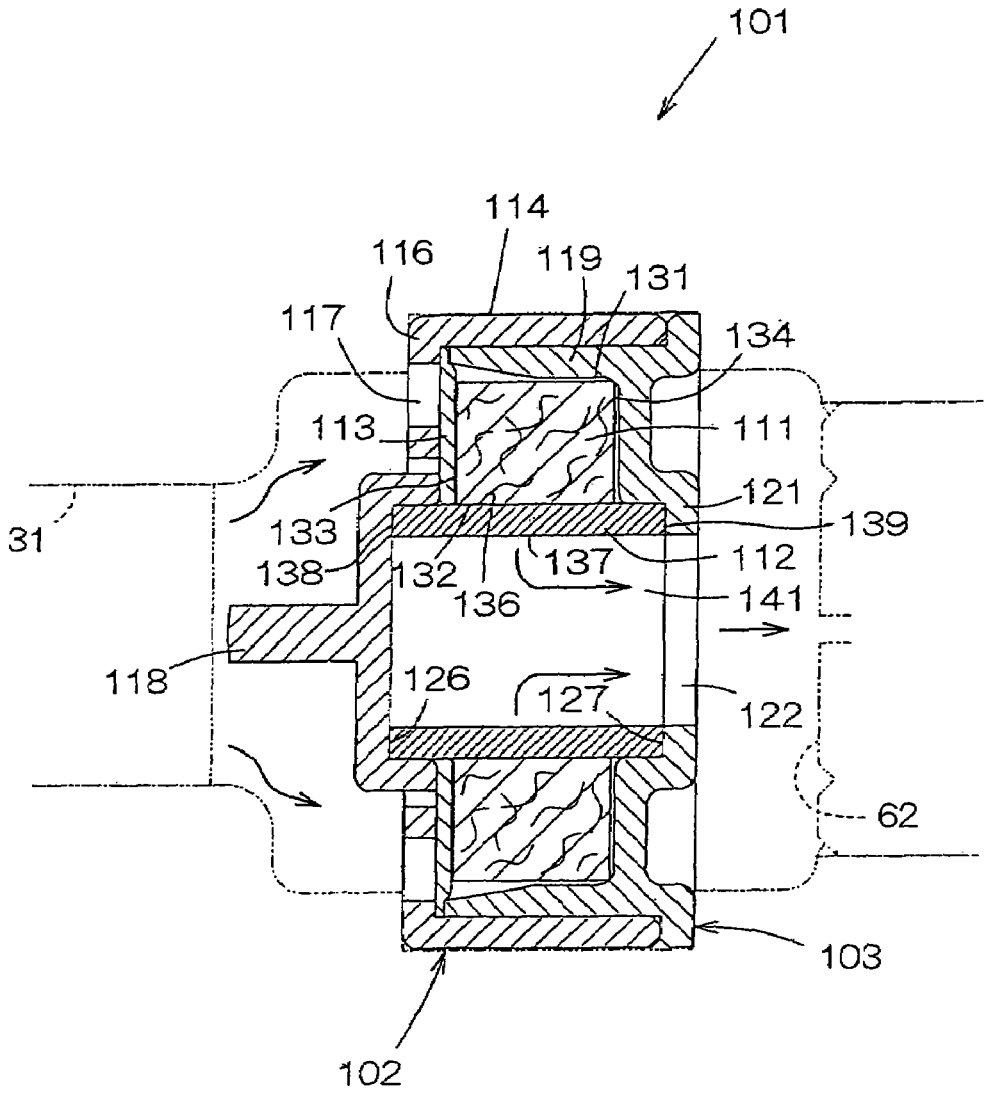
FIG. 4 is a scale-enlarged view of the filter shown in FIG. 3.
Figure 5:
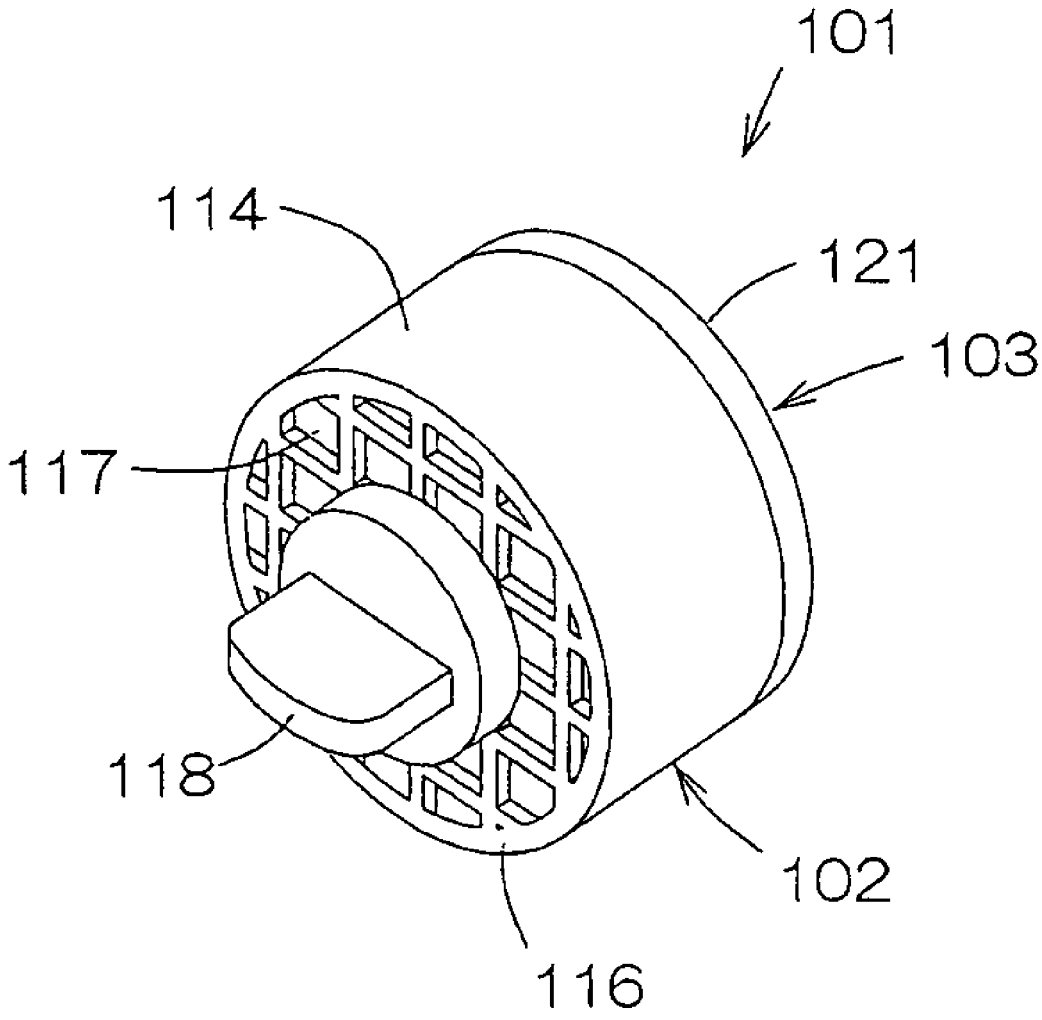
FIG. 5 is a perspective view of the filter.
Figure 6:
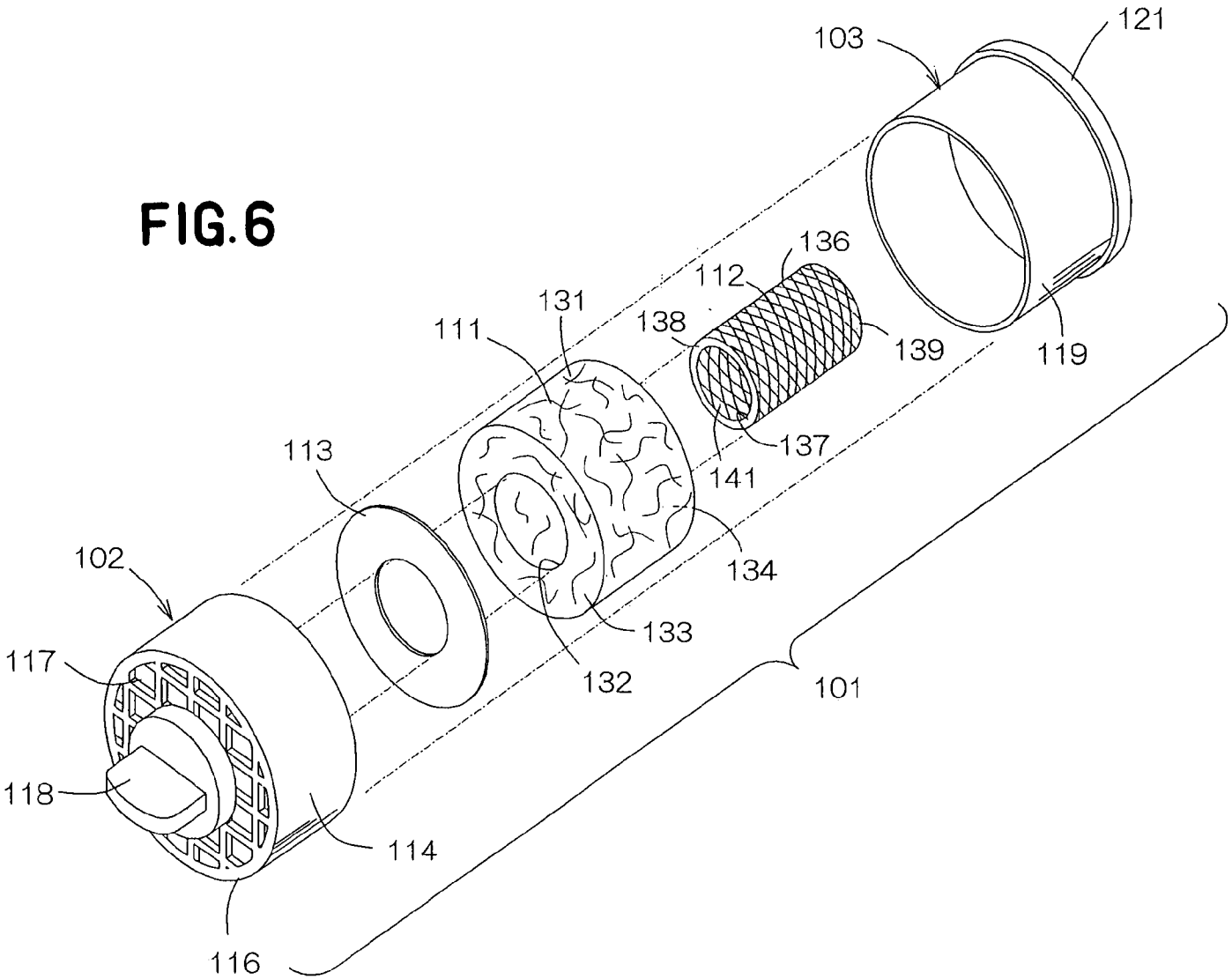
FIG. 6 is an exploded perspective view of the filter.

FIG. 4 is a scale-enlarged view of the filter assembly shown in FIG. 3, FIG. 5 is a perspective view of the filter assembly and FIG. 6 is an exploded perspective view of the filter assembly. The filter assembly comprises an outer cylindrical housing 102, an inner cylindrical housing 1–3 press-fitted to the outer cylindrical housing 102 from inside, first tubular filter medium 111 contained within the inner cylindrical housing 103, second tubular filter medium 112 press-fitted to the inner side of the first filter medium 111 and third filter medium 113 made of annular sheet strip interposed between the outer cylindrical housing 102 and the first filter medium 111. The outer cylindrical housing 102 is made of hard plastics and has a first peripheral wall 114 and a front wall 116 opposed to the rotary joint 31 wherein the front wall 116 is formed with a plurality of air vents 117 each having a sufficient opening area to assure smooth passage of the air and a finger-grip 118. The inner cylindrical housing 103 also is made of hard plastics and has a second peripheral wall 119 detachably press-fitted to the inner surface of the first peripheral wall 114 of the outer cylindrical housing 102 and a rear wall 121 opposed to the pipe sleeve 62 which is, in turn, formed at its center with a circular air vent 122.

The first filter medium 111 is of a tubular shape and has an outer peripheral surface 131; an inner peripheral surface 132, a first end surface 133 and a second end surface 134. The outer peripheral surface 131 is detachably brought in close contact with the inner peripheral surface of the inner cylindrical housing 102, the first end surface 133 is opposed to the front wall 116 of the outer cylindrical housing 102 and the second end surface 134 is opposed to the rear wall 121 of the inner cylindrical housing 103. The first filter medium 111 is formed, for example, by breathable open-cell polyurethane.

The second filter medium 112 also is of a tubular shape but thinner than the first filter medium 111 and has an outer peripheral surface 136, an inner peripheral surface 137, a first end surface 138 and a second end surface 139. The outer peripheral surface 136 is detachably brought in close contact with the inner peripheral surface 132 of the first filter medium 111. A tubular air passage 141 defined by the inner peripheral surface 137 has an inner diameter substantially same as a diameter of the air vent 122 of the inner cylindrical housing 103. The second filter medium 112 has meshes smaller than those of the first filter medium 111 and is preferably formed by material having a rigidity enough to prevent undesirable deformation of the first filter medium 111, e.g., ceramics or steel wire. The first and second end surfaces 138, 139 of such rigid second filter medium 112 are engaged with depressions 126, 127 formed in the front wall 116 of the outer cylindrical housing 102 and the rear wall 121 of the inner cylindrical housing 103, respectively, so that the first through third filter media 111 through 113 may be immobilized within these housings 102, 103.

The third filter medium 113 is laid immediately behind the air vents 117 of the outer cylindrical housing 102 so as to cover the first end surface 133 of the first filter medium 111. The third filter medium 113 may be formed, for example, by breathable nonwoven fabric, perforated plastic film or perforated paper.

The air from the low pressure hose 2 flows through the filter assembly in a direction indicated by an arrow in FIG. 4. More specifically, the air enters the air vents 117 of the outer cylindrical housing 102 and first passes through the third filter medium 113. The air having passed through the third filter medium 113 enters now the first filter medium 111 through its first end surface 133 and leaves this medium 111 through its inner peripheral surface 132. Then the air enters the second filter medium 112 through its outer peripheral surface 136 and leaves this medium 112 through its inner peripheral surface 137. The air is now discharged into the air passage and flows through the air vent 122 toward the pipe sleeve 62. The filter assembly 101 is placed aside toward the low pressure hose 2 with respect to the inhalation valve 64 press-fitted to the pipe sleeve 62 toward the low pressure hose 2 and therefore it is not apprehended that any impurities such as dust contained in the air might clog and/or accumulate between the pipe sleeve 62 and the inhalation valve 64.

The filter assembly 101 arranged as has been described above can be removably loaded within the second coupler member 5*b* after the first coupler member 5*a* has been unscrewed from the second coupler member 5*b* and thereby the interior of the second coupler member 5*b* has bee exposed. Whether the used filter assembly 101 should be exchanged with a fresh assembly or not can be determined by observing a degree of contamination of the third filter medium 113 due to the impurities such as dust through the air vents 117 of the outer cylindrical housing 102. The third filter medium 113 utilized as a reference of contamination check is preferably of a color which facilitates evaluation of contamination, e.g., of white. In the filter assembly according to the invention, the inner cylindrical housing 103 can be drawn off from the outer cylindrical housing 102 and therefore the first through third filter media 111 through 113 may be exchanged with respective fresh media without exchanging these cylindrical housings 102, 103 with respective fresh cylindrical housings. According to the invention, the filter assembly 101 may be formed by three filter media having different mesh sizes in order that whether the filter media should be exchanged with fresh media can be easily determined and/or the filter medium having smaller meshes can be protected from being clogged in a short period. However, even when the third filter medium 113 may be eliminated, or only the first filter medium or the second filter medium may be used, the present invention can be implemented. In the regulator 1 according to the present invention, an intake air flow can be increased by enlarging respective outer diameters of the outer and inner cylindrical housings 102, 103 in the filter assembly 101 and at the same time by extending a length of the air passage 141 in the second filter medium 112.

The present invention makes it possible to manufacture an improved regulator for diving free from any trouble in operation due to dust or the like contained in the air supplied from the air cylinder.

What is claimed is:

1. A regulator for diving comprising:

a tubular coupler member adapted to be coupled to an air hose extending from an air source;

a mouthpiece;

a diaphragm;

an air supply channel extending from said tubular coupler member to said mouthpiece being provided with a pressure reducing valve for said air adapted to be opened and closed by movement of said diaphragm and thereby to reduce the air pressure before said air is supplied to a diver holding said mouthpiece in his or her mouth; and said tubular coupler member containing therein a filter assembly for said air;

said filter assembly comprising a breathable cylindrical housing filted into said tubular coupler member and a filter medium contained within said housing, said cylindrical housing consisting of an outer cylindrical housing and an inner cylindrical housing separably inserted being formed with air vents, and said filter medium is exchangeably contained with said inner cylindrical housing.

2. The regulator according to claim 1, wherein said filter assembly is placed aside toward said air hose with respect to said pressure reducing valve.

3. The regulator according to claim 1, wherein the breathable cylindrical housing is detachably press-fitted into said tubular coupler member.

4. A regulator for diving comprising:

a tubular coupler member adapted to be coupled to an air hose extending from an air source;

a mouthpiece;

a diaphragm;

an air supply channel extending from said tubular coupler member to said mouthpiece being provided with a pressure reducing valve for said air adapted to be opened and closed by movement of said diaphragm and thereby to reduce the air pressure before said air is supplied to a diver holding said mouthpiece in his or her mouth;

said tubular coupler member containing therein a filter assembly for said air;

said filter assembly comprising a breathable cylindrical housing fitted into tubular coupler member, wherein said filter medium comprising first tubular filter medium and second tubular filter medium detachably press-fitted into said first tubular filter medium, said first tubular filter medium has meshes coarser than those of said second tubular filter medium and wherein an air passage in said filter medium starts from air vents formed in an outer cylindrical housing of the breathable cylindrical housing and terminates at an air vent formed in an inner cylindrical housing of the breathable cylindrical housing so that, along said air passage, said air enters said first tubular filter medium through its one end surface, after has left this medium through its inner peripheral surface, enters said second tubular filter medium through its outer peripheral surface and leaves this medium through its inner peripheral surface and reaches said air vent formed in said inner cylindrical housing.

5. The regulator according to claim 4, wherein a third filter medium in the form of a sheet is laid at the innermost position of said air vents of said outer cylindrical housing so that said third filter medium may cover said one end surface of said first filter medium and a surface state of said third filter medium may be observed through said air vents.

6. The regulator according to claim 4, wherein said filter assembly is placed aside toward said air hose with respect to said pressure reducing valve.

7. The regulator according to claim 4, wherein the breathable cylindrical housing detachably is press-fitted into said tubular coupler member.

* * * * *